United States Patent [19]

Balland

[11] 4,149,847

[45] Apr. 17, 1979

[54] PROCESS FOR TREATING TEXTILE FIBERS WITH A DYE CONTAINING AN ANTIMIGRATION AGENT

[75] Inventor: Jean Balland, Chateaurenault, France

[73] Assignee: Manufacture de Produits Chimiques Protex S.A., Paris, France

[21] Appl. No.: 843,216

[22] Filed: Oct. 18, 1977

[30] Foreign Application Priority Data

Oct. 20, 1976 [FR] France ..... 76 32287

[51] Int. Cl.[2] ..... C09B 65/00

[52] U.S. Cl. ..... 8/1 XA; 8/2; 8/18 R; 8/18 A; 8/21 C; 8/30; 8/34; 8/85 B; 8/54.2; 8/100 A; 260/4 R; 427/390 R

[58] Field of Search ..... 8/1 XA, 2, 30, 100 A, 8/34, 18 R, 34, 18 A

[56] References Cited

U.S. PATENT DOCUMENTS

| | | | |
|---|---|---|---|
| 3,326,628 | 6/1967 | Olaj et al. | 8/85 |
| 3,860,548 | 1/1975 | Roccheggiam et al. | 8/85 |
| 4,053,440 | 10/1977 | Bonnet et al. | 260/29.6 ME |

FOREIGN PATENT DOCUMENTS

| | | | |
|---|---|---|---|
| 1385244 | 1/1965 | France. | |
| 830872 | 3/1960 | United Kingdom | 8/85 |

*Primary Examiner*—A. Lionel Clingman
*Attorney, Agent, or Firm*—Karl F. Ross

[57] ABSTRACT

A disperse dye, vat dye or phthalocyanine dye and a process for the application thereof are disclosed, said dye comprising an effective amount of an antimigration agent of the formula:

$$(O{=}C{=}N)_x{-}R{-}\left[NH{-}CO{-}O{-}\left[C_nH_{2n}O\right]_p R'\right]_y$$

wherein

R is an aliphatic or aromatic moiety containing at least one biuret, urethane or isocyanate group;

R′ is selected from the group which consists of hydrogen, $C_1$ to $C_8$ straight or branched chain alkyl, aryl or alkylaryl;

x is 0 to 1;

y is greater than 2;

n is 2 to 4; and p is at least 5.

9 Claims, No Drawings

PROCESS FOR TREATING TEXTILE FIBERS WITH A DYE CONTAINING AN ANTIMIGRATION AGENT

CROSS REFERENCE TO RELATED APPLICATION

This application is related to my copending U.S. Application Ser.No. 818,676 filed July 25, 1977.

FIELD OF THE INVENTION

This invention relates to new disperse, vat and phthalocyanine dye systems which contain antimigration agents and a process for applying these dyes to textile fibers.

BACKGROUND OF THE INVENTION

In dyeing processes which include an immersing step, a pressing (squeezing) step and a drying step, certain types of dyed textiles often undergo the phenomenon of migration of the dye. Such migration usually occurs during the drying step. The dye migrates in direct proportion to the temperature of the dryer and from the interior of the textile to its surface. As a result the textile contains blotches of concentrated dye.

These blotches are undesirable because the unevenly dyed textile cuts poorly and undergoes a so-called "double-face" effect.

A certain number of compounds have already been prepared in order to reduce the dye migration in textiles. Unfortunately these compounds, which are often macromolecules, mechanically obstruct the dye particles. These macromolecules include cellulosics, alginic acid derivatives, copolymers of each, and copolymers of acrylic acids, methacrylic acids and/or both acids.

OBJECT OF THE INVENTION

The object of this invention is to carry out disperse, vat and phthalocyanine dyeing without the problems of the respective dyes' migrating on the particular textile substrate.

SUMMARY OF THE INVENTION

This object and others which will become apparent hereinafter are attained, in accordance with the present invention, by using in the particular disperse dye, vat dye or phthalocyanine dye selected for a particular dye bath, an antimigration agent which is a urethane-oxy-alkylene copolymer of the formula:

$$(O=C=N)_x-R-[NH-CO-O-[C_nH_{2n}O]_pR']_y$$

wherein R is an aliphatic or aromatic moiety which contains biuret, urethane, or isocyanate groups; R' is selected from the group which consists of hydrogen, $C_1$ to $C_8$ straight or branched chain alkyl, aryl or alkylaryl; x is 0 to 1; y is greater than 2; n is 2 to 4; and p is at least 5. The value of p can often be 100 or even higher.

The radical R' can be for example methyl, ethyl, propyl, butyl, isobutyl, 2-ethylhexyl, benzyl, phenyl, tolyl, xylyl, octylphenyl, nonylphenyl, or naphthyl.

The radical R in the formula above is well known to those skilled in the art as typically bonding to isocyanates. The radical R' is equally well known to associate generally with polyalkylene glycols and their ethers.

The amount of the urethane-alkylene copolymer added to the dye bath in the form of a 30% aqueous solution varies as a function of the amount of the particular dye employed and varies from 2 to 50 g/l of colorant. Preferably the amount of the copolymer is between 5 and 20 g/l.

According to another important feature of the invention the urethane-oxy-alkylene copolymer can be used simultaneously with other well-known antimigration agents of high molecular weight such as polyacrylic acids, polymethacrylic acids, mixtures of these two polymers, cellulosics, and alginic acids. Together the urethane-alkylene copolymers and the known antimigration agents exert a synergistic effect which is greater than that of the individual antimigration additives employed at substantially higher concentrations.

Also with respect to disperse dyes the use of the urethane-alkylene copolymers definitely increases the color intensity of the dye applied to the textile fibers.

SPECIFIC EXAMPLES

Example 1

In a 2-liter flask provided with an agitator, a thermometer and a reflux condenser, 500 grams of toluene and 100 grams of the monobutylic ether of a copolymer of ethylene glycol and propylene glycol (in the proportion 50/50 by weight) of a molecular weight of about 10,000, are processed. Traces of water are first eliminated by azeotropic distillation of the water-toluene and then 2.5 grams of the polyisocyanate of phenylene polyisocyanate (commercially marketed under the designation PAPI) are added prior to the reaction. The mixture is heated at 100° to 110° C for a period of three hours whereupon the toluene is eliminated by distillation in vacuo at 170° C and 40 mm of mercury.

The product (A) thus obtained is a clear yellow oil of high viscosity, soluble in cold water, having a cloud point of 44° C.

Example 2

The method of Example 1 is followed utilizing an excess of phenylene polyisocyanate with respect to the butylic monoether of polyethylene/polypropylene glycol (50/50 by weight).

The product (B) thus obtained, which contains isocyanate groups in a free or reactive state, can then be reacted with water and is a brownish clear oil of high viscosity, soluble in cold water and having a cloud point of 38° C.

Example 3

Into a 2-liter flask provided with an agitator a thermometer and a reflux condenser, there are introduced 500 grams of toluene and 100 grams of the butylic monoether of polyethylene glycol-polypropylene glycol of molecular weight on the order of 8000, the ethyleneglycol and the propyleneglycol being present in a proportion of 50/50 by weight.

After elimination of water by azetropic distillation, 3.5 grams of a solution of 75% concentration of polyisocyanate, obtained by condensation of hexymethylene diisocyanate with water, is introduced. This polyisocyanate is commercially marketed under the name DESMODUR N.

The mixture is refluxed for two hours and the solvent is eliminated by distillation at 170° C under a vacuum of 40 mm of mercury.

An oily product (C) of yellowish clear color is obtained. The product is soluble in cold water and has a cloud point of 44° C.

Example 4

Into a 2-liter flask provided with an agitator, thermometer and reflux condenser, 500 grams of toluene and 100 grams of the butylic monoether of polyethylene glycol/polypropylene glycol (50/50 by weight) with a molecular weight of 10,000 are introduced.

After the water has been eliminated by azeotropic distillation, 5.7 grams of a 75% solution of a polyisocyanate obtained by the condensation of toluene disocyanate with trimethylpropane, in ethylacetate, is introduced. The polyisocyanate is commercially available under the name DESMOUR L. The mixture is refluxed for threee hours and the toluene is then removed by vacuum distillation at 40 mm mercury and 170° C.

The product (D) thus obtained is a very viscous yellow oil soluble in cold water and having a cloud point of 42° C.

Example 5

Into a 2-liter flask provided with an agitator, a thermometer and a reflux condenser, there are introduced 500 ml of toluene, 70 grams of butylic monoether of polyethylene/polypropylene glycol (proportion 50/50 by weight) with a molecular weight of 10,000, and 30 grams of the monyphenolether of polyethylene glycol having a molecular weight of 1524. After elimination of traces of water by azetropic distillation, 7.2 grams of a solution commercially available under the name DESMODUR N is introduced. This solution has a concentration of 751 % by weight of a mixture of ethylglycolacetate and xylenepolyisocyanate.

The reaction mixture is refluxed for three hours, the solvents being eliminated by distillation at 170° C under a vacuum of 40 mm of mercury.

The product (E) thus obtained is white, highly viscous, soluble in cold water and has a cloud point of 41° C.

Example 6

The preceding Example is repeated with a mixture of 70 grams of the monobutylether of polyethylene-polypropylene glycol (proportion 50/50 by weight) with a molecular weight of 10,000 and 30 grams of a copolymer sequence: polyethylene-polypropylene glycol commercially marketed under the name PLURONIC of a molecular weight of 1830, and 8.5 grams of the polyisocyanate of Example 5.

The product (F) which is obtained is highly viscous, white, soluble in cold water and has a cloud point of 45° C.

Example I

A polyester-cotton weave (67% polyester, 33% cotton) was impregnated in a bath having the following composition:

30 g/l of a disperse dye referenced in the Color Index under the name "Disperse Red 74";
3 $cm^3$ of 80% acetic acid; and
20 g/l of an aqueous solution of urethane-alkylene copolymer A (supra and according to Example I of U.S. application Ser. No. 601,042 — now U.S. Pat. No. 4,053,440).

After impregnation in the dye bath the woven fabric was pressed between rollers in such a fashion as to retain 80% of its original weight after leaving the dye-impregnating bath.

The woven fabric was next subjected to a rapid preliminary drying by passing through a tunnel provided with infrared heating elements having a spectrum such that an emission spectrum lies between 2.3 and 3.4 nanometers (wavelength); the drying time in the tunnel was 15 seconds.

After leaving the tunnel, the fabric was again made wet and a metal plaque was placed on top of the fabric, in order to accentuate the migration phenomenon. Liquid was extracted from the sample weave which was then subjected to a thermal treatment lasting one minute.

Subsequent to the final drying it can be stated that the weave was dyed perfectly uniformly. The right side of the sample which was in direct contact with the metal plaque still had a uniform, unblotched color indicating total absence of dye migration.

When the same procedures were carried out as above but in the absence of the claimed polymer solution A, the obtained dyed weave had irregular coloration on the surface. Also, the right side of the weave on which the metal plaque had been placed had irregular surface coloration indicating that the dye had in fact migrated. Also the color intensity of the weave dyed according to the invention was considerably greater than that of the weave dyed without the benefit of the antimigration additive.

Example II

The conditions used were identical with those of Example I except that in place of the 20 g/l aqueous solution A (supra), a 20 g/l aqueous solution of the copolymer of Example 3 of that same patent application was used. After that treatment the results obtained were similar to those of Example I; that is, total absence of dye migrating from the sample where the dye used included the copolymer additive according to the invention.

Example III

The same procedures and reaction conditions as in Example I were employed except that the dyes used were the disperse dyes with the following designations:

Disperse Blue 56
Disperse Orange 45
Disperse Yellow 54
Disperse Red 73

After treatment results were obtained that were similar to those of Example 1; that is the total absence of dye migration in the presence of the urethane-alkylene copolymer additive.

EXAMPLE IV

A sample of woven cotton cloth, previously bleached, was immersed in a dye bath having the following composition:

20 g/l of one of the vat dyes listed hereinafter;
3 $cm^3$/l acetic acid; and
15 g/l of a 30% aqueous solution of a urethane-alkylene copolymer A.

Dyes

The vat dyes named below were used in a finely dispersed form and are known in the Color Index by the following designations:

Vat Brown I
Vat Blue IV
Vat Green I
Vat Orange XV.

After impregnation in the dye bath the cloth was pressed between rollers in such a fashion as to retain 80% of its weight immediately subsequent to its removal from the bath.

Next the cloth sample was subjected to rapid preliminary drying at 100° C as in Example I in the presence of a metallic plaque. After drying all of the cloth samples were uniformly colored without any dye migration occurring on the side of the cloth which had been in contact with the metal plaque.

However, without the addition of the copolymer additive according to the invention the cloth samples appeared white at the location that had been in direct contact with the metal plaque. Hence significant migration of the dye had occurred.

Example V

A polyester-cotton cloth was immersed in a bath having the following composition:

40 g/l of diverse dyes not referred to in the Color Index and constituting a mixture of disperse dyes and vat dyes and commercially available under the names TERACOTON (Ciba-Geigy) or COTTESTREN (BASF);
3 $cm^3$/l of 80% acetic acid;
20 g/l of a 30% aqueous solution of alkylene-urethane copolymer A.

After impregnation in the dye bath and pressing, the same procedures as in Example I were employed. After drying the usual problem of dye migration was not apparent with respect to either the polyester or cellulose fibers within the cloth. However, without addition of the copolymer additive according to the invention the phenomenon of dye migration did occur.

Example VI

The same procedures and reaction conditions as in Example I were used, except that the dye composition was as follows:

30 g/l of a disperse dye (Disperse Red 74);
3 $cm^3$/l of 80% acetic acid;
10 g/l of an aqueous solution constituted by the following components per 100 g of solution:
- 40 g of a 30% aqueous solution of a urethane alkylene copolymer A, and
- 60 g of a 15% aqueous solution of a sodium polyacrylate of a molecular weight greater than 50,000 and generally between 50,000 and 250,000.

After drying it could be seen that there was a complete absence of migration of dye through the cloth. Furthermore the results were superior to those achieved when each of the above polymer components was individually used as the antimigration additive even at highly elevated concentrations (i.e. 10 g/l of a 30% solution of the urethane-alkylene copolymer or 10 g/l of a 15% solution of the sodium polyacrylate).

Example VII

The same procedures and reaction conditions were employed as in Example VI, except that the antimigration additive had the following composition:

40 g of a 30% aqueous solution of a urethane-alkylene copolymer obtained according to Example 1 of U.S.-patent application Ser. No. 601,042; and
60 g of a 5% aqueous solution of sodum acrylate.

After drying it could be seen that the mixture of the two components permitted results superior to those obtained when each component was applied individually and as in Example VI even at elevated concentrations.

Similar results were obtained with the urethane-alkylene copolymers B - F of Examples 1 - 6 as applied in Examples 1 - VII.

I claim:

1. In a process for dyeing textile fibers with disperse dyes, vat dyes or phthalocyanine dyes wherein the textile fibers are contacted with an aqueous dye bath, the improvement which comprises the step of:

adding to the dye bath a urethane-oxyalkylene antimigration copolymer of the formula:

$$(O{=}C{=}N)_x{-}R{-}[{-}NH{-}CO{-}O{-}({-}C_nH_{2n}{-}O{-})_p{-}R']_y$$

wherein
R is an aliphatic or aromatic moiety containing at least one biuret, urethane or isocyanate group;
R′ is selected from the group which consists of hydrogen, $C_1$ to $C_8$ straight or branched-chain alkyl, aryl or alkylaryl;
x is 0 to 1;
y is greater than 2;
n is 2 to 4; and
p is at least 5.

2. The improvement defined in claim 1 wherein the urethane-alkylene copolymer is added to the disperse dye, vat dye, or phthalocyanine dye as a function of the amount of the individual dye present in an amount of 2 to 50 g/l.

3. The improvement defined in claim 2 wherein the urethane-alkylene copolymer is added to the disperse dye, vat dye or phthalocyanine dye as a function of the amount of the individual dye present in an amount of 5 to 20 g/l.

4. The improvement defined in claim 1 wherein the urethane-alkylene copolymer is used simultaneously with a second antimigration agent selected from the group consisting of polyacrylic acids, cellulosics, and alginic acids to achieve a synergistic effect which prevents migration of the dye from the fabric.

5. The improvement defined in claim 1 wherein the dyed fibers are subjected to an intra-red radiation treatment to effect coagulation of the urethane-alkylene copolymer prior to drying to avoid migration of the dye.

6. The improvement defined in claim 1 wherein p is at most 100.

7. Textile material dyed according to the improvement defined in claim 1.

8. An aqueous disperse dye, vat dye or phthalocyanine dye system which comprises an effective amount of an antimigration agent in the form of a thermocoagulable latex of the formula:

$$(O-C-N)_x-R-[-NY-CO-O-(-C_nN_{2n}-O-)_p-R']_y$$

wherein

R is an aliphatic or aromatic moiety containing at least one biuret, urethane or isocyanate group;

R′ is selected from the group which consists of hydrogen, $C_1$ to $C_8$ straight or branched-chain alkyl, aryl or alkylaryl;

x is 0 to 1;

y is greater than 2;

n is 2 to 4; and p is at least 5.

9. The improvement defined in claim 1 wherein said bath is free from any thermocoagulable latex apart from said copolymers.

* * * * *